US006464540B1

(12) United States Patent
Sato

(10) Patent No.: US 6,464,540 B1
(45) Date of Patent: Oct. 15, 2002

(54) CONNECTOR UNIT HAVING SIGNAL PATHS SUBSTANTIALLY EQUAL TO ONE ANOTHER IN DELAY TIME OF SIGNALS TRANSMITTED THERETHROUGH

(75) Inventor: Nobuyuki Sato, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/873,915

(22) Filed: Jun. 4, 2001

Related U.S. Application Data

(63) Continuation of application No. 09/335,681, filed on Jun. 18, 1999.

(30) Foreign Application Priority Data

Jun. 19, 1998 (JP) ..... 10-172587

(51) Int. Cl.[7] ..... H01R 12/00
(52) U.S. Cl. ..... 439/668; 439/60; 439/494
(58) Field of Search ..... 439/66, 67, 74, 439/474, 65, 80, 660, 668, 701, 277, 60

(56) References Cited

U.S. PATENT DOCUMENTS

| | | | | | |
|---|---|---|---|---|---|
| 2,749,526 | A | * | 6/1956 | Petersen | 439/65 |
| 4,201,432 | A | * | 5/1980 | Chalmers | 439/74 |
| 4,392,705 | A | * | 7/1983 | Andrews, Jr. et al. | 439/74 |
| 4,934,943 | A | | 6/1990 | Klein et al. | 439/65 |
| 5,154,618 | A | * | 10/1992 | Nikoloff et al. | 439/67 |
| 5,338,207 | A | | 8/1994 | Lineberry | 439/65 |
| 5,660,551 | A | | 8/1997 | Sakurai | 439/108 |
| 5,785,534 | A | | 7/1998 | Longueville et al. | 439/65 |
| 6,322,372 | B1 | * | 11/2001 | Sato | 439/65 |

FOREIGN PATENT DOCUMENTS

| | | |
|---|---|---|
| JP | 60-50878 | 3/1985 |
| JP | 5-121884 | 5/1993 |
| JP | 7-122335 | 5/1995 |
| JP | 8-315916 | 11/1996 |

* cited by examiner

*Primary Examiner*—Neil Abrams
*Assistant Examiner*—J. F. Duverne
(74) *Attorney, Agent, or Firm*—Foley & Lardner

(57) ABSTRACT

In a connector unit having primary and secondary connectors (11 and 12) which have a plurality of primary contact leads (111) and a plurality of secondary contact leads (121) which correspond to the respective primary contact leads (111), the primary contact leads (111) have primary contact ends displaced from one another in a predetermined direction. The secondary contact leads (121) have secondary contact ends which are extended in an opposite direction to be contacted with the corresponding primary contact ends and which are displaced stepwise to compensate for the displacement of the primary contact ends and to thereby reduce a variation of sums of the primary and the secondary contact leads (111 and 121).

4 Claims, 4 Drawing Sheets

C1-C2

CONNECTOR UNIT HAVING SIGNAL PATHS SUBSTANTIALLY EQUAL TO ONE ANOTHER IN DELAY TIME OF SIGNALS TRANSMITTED THERETHROUGH

RELATED APPLICATIONS

This application is a continuation of U.S. Ser. No. 09/335,681, filed Jun. 18, 1999, which claims priority under 35 USC §119 from Japanese application JP 10-172587, filed Jun. 19, 1998.

BACKGROUND OF THE INVENTION

The present invention relates to a connector unit for electrical and removable connection of primary and secondary electric devices and, in particular, to the connector unit which comprises primary and secondary connectors connected to the primary and the secondary electric devices.

In a conventional connector unit of the type described above, the primary and the secondary connectors generally comprise a plurality of primary and secondary contact leads, respectively. Furthermore, at least one of the primary and the secondary connectors (for example, the primary connector) is generally a right-angle type so that one (primary) contact lead is arranged over top of another in turn. Namely, one primary contact lead is arranged over top of another in a height direction of the primary connector.

When the primary and the secondary connectors are connected to each other, the primary contact leads and the secondary contact leads are connected to each other, respectively, to thereby form a plurality of signal paths for transmitting signals, respectively. The signal paths have different lengths from one another. This is because one primary contact lead is longer than another as mentioned above. Therefore, signals transmitted through the signal paths are different from one another in delay or passage time. The delay-time difference among transmission of signal is often called "skew".

Recently, the connector unit is requested to transmit high frequency signal at a high speed when applied to such electric devices as a circuit board provided with a large scale integrated semiconductor chip, a data storage device, and so on. However, the electric devices can not perform their functions at a desired high speed by signal transmission through the conventional connector unit because the signals transmitted through the signal paths have different delay times as described above.

Furthermore, the connector unit is also required to increase a number of signal paths because the electric devices recently tend to because large in the number of input/output signals. In the conventional connector unit, when the number of signal paths is increased, the numbers of the primary contact leads and the secondary contact leads must be also increased. This results in an increase of a difference between the shortest length and the longest one of the primary contact leads. As the difference in length among the signal paths becomes large, a difference among the time delays are also increased.

Also, the connector unit is required to reduce a size thereof because electric devices having a compact size suitable for a mobile and/or a small place use are recently required. Particularly, the connector unit is required to reduce a height thereof when mounted on the electric device such as the circuit board. When heights of the connectors are reduced while the number of signal paths is increased as mentioned above, the primary and the secondary contact leads arranged in the connectors must be arranged at a very short pitch. Such a very short pitch of arrangement increases a cross talk between adjacent ones of the contacts.

In order to transmit a high frequency signal, two conventional connectors are disclosed for example in Japanese Patent Unexamined Publications (JP-A) Nos. 315916/1996 and 122335/1995, respectively. The connectors have the contact leads arranged at a slant in order to shorten lengths thereof. Furthermore, the signal contact leads are arranged alternately with the ground contact leads and/or the signal contact leads are surrounded by the ground contact leads. Thus, this structure enables improvement of the cross talk mentioned above. However, the skew is not much improved by both the connectors maintained in both of the publications. In addition, the height and/or the size can not be small with both the connectors.

SUMMARY OF THE INVENTION

It is therefore an object of the present invention to provide a connector unit which can transmit signals at a substantially equal delay time.

It is another object of the present invention to provide a connector unit which can make signal paths substantially equal to one another in delay time.

It is still another object of the present invention to provide a connector unit which can be reduced in height thereof.

The other objects, features, and advantages of the present invention will become clear as the following description proceeds.

The present invention is directed to a connector unit comprising a primary connector which has a plurality of primary contact leads extended in a predetermined direction and a secondary connector having a plurality of secondary contact leads extended in a direction opposite to the predetermined direction. The primary contact leads have a plurality of primary contact ends, respectively. On the other hand, the secondary contact leads have a plurality of secondary contact ends brought into contact with the corresponding primary contact ends. The primary contact ends are displaced stepwise in the predetermined direction while the secondary contact ends are displaced stepwise to compensate for the displacement of the primary contact ends and to thereby shorten a variation of sums of the primary and the secondary contact leads.

DESCRIPTION OF THE PREFERRED EMBODIMENTS

Figure 1:
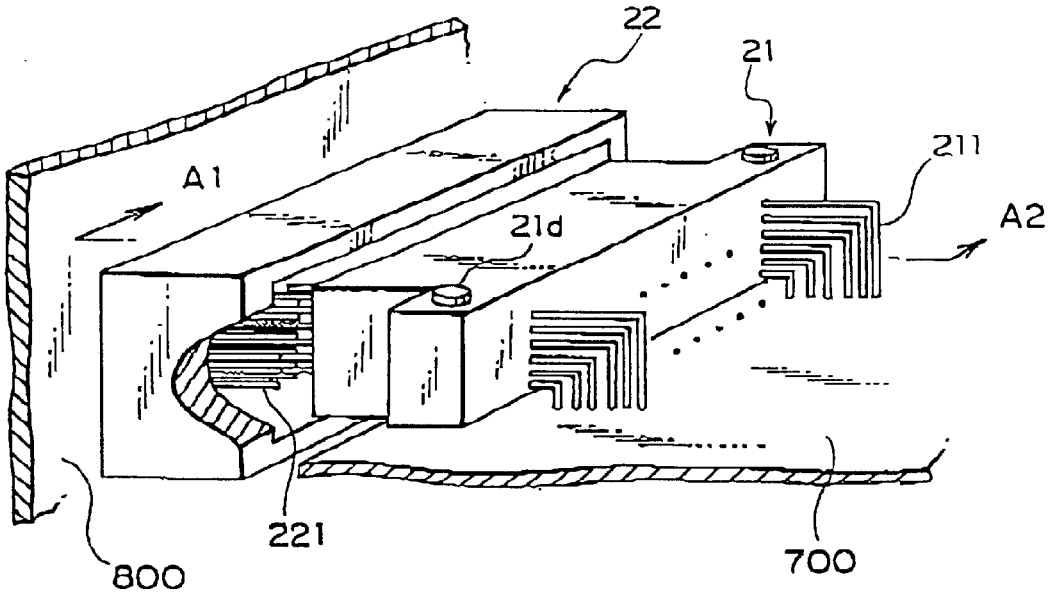
FIG. 1 PRIOR ART
FIG. 1 is a perspective view showing a conventional connector unit.

In order to facilitate an understanding of the present invention, description will at first be made with reference to the drawing about a conventional connector unit which is substantially equivalent to that described in the preamble of the present specification.

Figure 2:
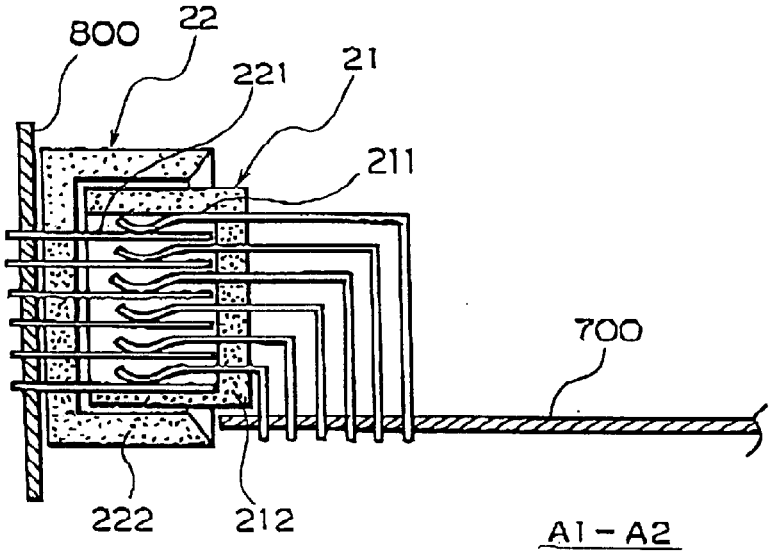
FIG. 2 PRIOR ART
FIG. 2 is a cross sectional view of the connector unit with the two connectors thereof connected to each other shown in FIG. 1 along a line A1–A2 in FIG. 1.

Referring to FIGS. 1 and 2, the conventional connector unit is used for electrical and removable connection between primary and secondary printed circuit boards 700 and 800 as primary and secondary electric devices. The connector unit comprises primary and secondary connectors 21 and 22 respectively mounted on one main surfaces of the printed circuit boards 700 and 800.

The primary connector 21 comprises a primary insulator 212 and a plurality of primary contact-sets respectively provided with six primary contact leads 211 and supported in the primary insulator 212. The primary contact-sets are arrayed horizontally in parallel with one another so that the primary contact leads are superposed on one another with a space left in the primary insulator 212. The primary contact leads 211 are arranged in parallel to one another. The primary contact leads 211 have different lengths from one another. This is because that the primary connector is the right-angle type so that one primary contact lead 211 is arranged over top of another primary contact lead 211 in turn. In other words, one primary contact lead 211 is arranged over top of another primary contact lead 211 in a height direction of the primary connector 21. One ends of each of the primary contact leads 211 are soldered in the primary printed circuit board 700. Furthermore, the primary insulator 212 is fixed on the primary printed circuit board 700 by the use of screws 21*d*.

Likewise, the secondary connector 22 comprises a secondary insulator 222 and a plurality of secondary contact-sets respectively provided with six secondary contact leads 221 and supported in the secondary insulator 222. The secondary contact-sets are arrayed horizontally in parallel with one another so that the secondary contact leads are superposed on one another with a space left in a direction of the secondary insulator 222. The secondary contact leads 221 of each set are horizontally extended and arranged in parallel to one another. However, it is to be noted that the secondary contact leads 221 have the same length as one another. Namely, the secondary connector 22 has no bent portion and is not the right-angle type connector. In any event, the secondary contact leads 221 have ends soldered to the secondary printed circuit board 800.

As is apparent from FIG. 2, a plurality of signal paths for transmitting signals are formed or established between the primary and the secondary printed circuit boards 700 and 800. The signal paths have different lengths from one another because the primary contact leads 211 have different lengths from one another as mentioned above.

The conventional connector unit has disadvantages, as described in the preamble of the instant specification.

Now, preferred embodiments of the present invention will be described with reference to FIGS. 3 to 7.

First Embodiment

Figure 3:
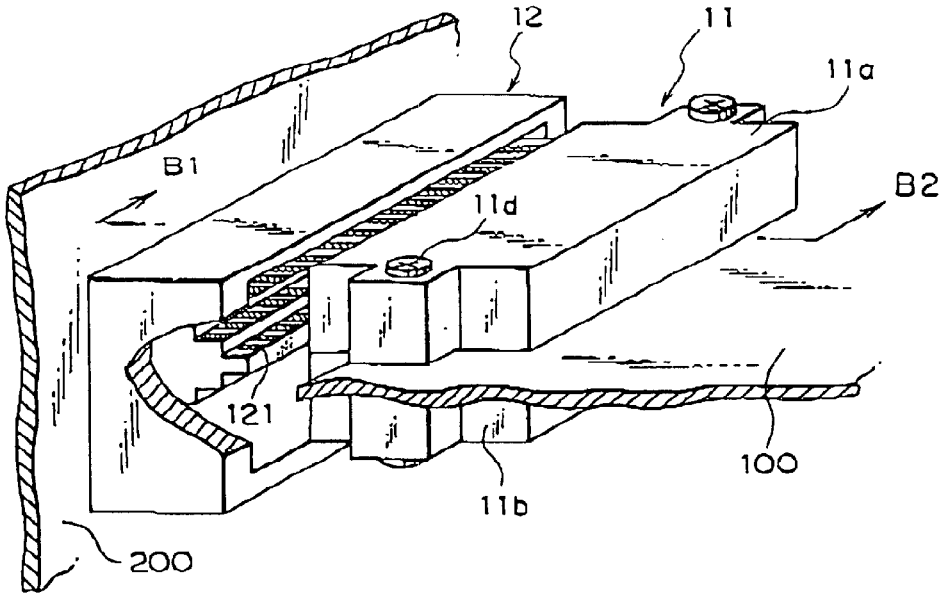
FIG. 3 is a perspective view showing a connector unit according to a first embodiment of the present invention.
Figure 4:
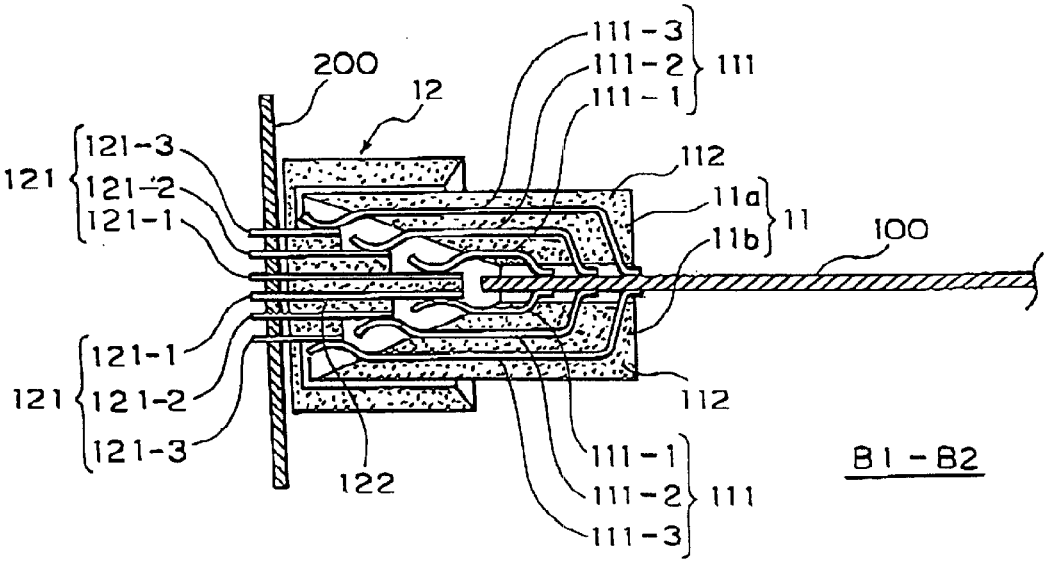
FIG. 4 is a cross sectional view of the connector unit with the two connectors thereof connected to each other shown in FIG. 3 along a line B1–B2 in FIG. 3.

Referring to FIGS. 3 and 4, a connector unit according to a first embodiment of the present invention is used for electrical and removable connection between primary and secondary printed circuit boards 100 and 200 which will be called as primary and secondary electric devices, respectively. The primary printed circuit board 100 is horizontally extended and is provided with first and second main surfaces on which wiring patterns (not shown) are printed. The connector unit comprises primary and secondary connectors 11 and 12 both of which are electrically connected to each other. The illustrated primary connector 11 is divided into first and second primary connectors 11*a* and 11*b* which are mounted on and attached to first and second main surfaces of the primary printed circuit board 100, respectively.

On the other hand, the secondary connector 12 is mounted on and attached to a main surface of the secondary printed circuit board 200 perpendicular to the primary printed circuit board 100.

In the primary connector 11, each of the first and the second primary connectors 11*a* and 11*b* comprises a primary insulator 112 and a plurality of primary contact-sets arranged in adjacent rows. As showing FIG. 4, each of the primary contact-sets is provided with three primary contact leads (collectively shown by 111) and which are supported in the primary insulator 112. Although not explicitly shown in FIGS. 3 and 4, a pair of primary contact-sets is horizontally arrayed in parallel to one another so that the primary contact leads 111 in each pair of the primary contact-sets are identical with or superposed on one another in the primary insulator 112. The primary contact leads 111 of each primary contact-sets are arranged in parallel to one another and have different lengths from one another, like in FIGS. 1 and 2 are. More specifically, each primary contact-set comprises first through third primary contact leads 111-1, 111-2, and 111-3. The number of the primary contact leads may not be restricted to three but increased or decreased. In this connection, the number of the primary contact leads may be generalized by n, where n is an integer not smaller than 2. As shown in FIG. 4, the primary contact lead 111-2 is arranged or stacked over the primary contact lead 111-1 with a spacing left to the primary contact lead 111-1 and the primary contact lead 111-3 is arranged or stacked over the primary contact lead 111-2 with a spacing left to the primary contact lead 111-2 in turn. From this fact, it is readily understood that an n-th one of the primary contact lead is arranged over an (n−1)-th primary contact lead 111-(n−1) in a height direction of the primary connector 11. As shown in FIG. 4, the primary contact lead 111-2 is longer than the primary contact lead 111-1 and the primary contact lead 111-3 is longer than the primary contact lead 111-2 in turn.

The first and the second primary connectors 11*a* and 11*b* are mechanically coupled to each other by screws 11*d* to support the primary printed circuit board 100. In addition, the primary contact leads 111 of the first and the second primary connectors 11*a* and 11*b* are press-fitted to the first and the second main surfaces of the primary printed circuit board 100 to be electrically connected to the printed circuit, respectively. Namely, the primary contact leads 111 have one ends connected mechanically and electrically to the primary printed circuit board 100 without soldering.

The primary contact leads 111 of the first and the second primary connectors 11*a* and 11*b* are provided with first portions which are contiguous to and extended from the first and the second primary main surfaces of the primary printed circuit board 100 in a direction remote from the main surfaces and second portions which are extended from the first portions in parallel to the first and the second primary main surfaces, respectively. The primary contact leads 111 except for both ends thereof are embedded in the primary insulator 112. One and the other ends of the primary contact leads 111 have elasticity.

On the other hand, the secondary connector 12 comprises a secondary insulator 122 and first and second contact lead-groups of secondary contact leads arranged in adjacent rows corresponding to the rows of the primary contact. The first and the second contact lead-groups are provided with a plurality of secondary contact-sets, respectively. The secondary contact-sets are arrayed horizontally in parallel with one another so that the secondary contact leads 121 are identical with those of the other sets and can be superposed on one another. The secondary contact-sets are provided with three secondary contact leads (collectively shown by 121) in each of the first and the second contact-groups.

The secondary contact leads 121 of each contact-groups are arranged in parallel to one another as shown in FIG. 4. The secondary contact leads 121 have different lengths from one another. More particularly, the illustrated secondary contact leads 121 are composed of first through third secondary contact leads 121-1, 121-2, and 121-3 but the number of the secondary contact leads may be represented by n, like in the primary contact leads. Therefore, the secondary contact leads may be generally expressed as first thorough n-th contact leads. As shown in FIG. 4, the secondary contact lead 121-2 is arranged or stacked over the secondary contact lead 121-1 with a spacing left to the secondary contact lead 121-1 and the secondary contact lead 121-3 is arranged or stacked over/under the secondary contact lead 121-2 with a spacing left to the secondary contact lead 121-2 in turn. Thus, an n-th one of the secondary contact lead is arranged over/under an (n−1)-th secondary contact lead 121-(n−1) in a height direction of the secondary connector 12. As shown in FIG. 4, the secondary contact lead 121-2 is shorter than the secondary contact lead 121-1 and the secondary contact lead 121-3 is shorter than the secondary contact lead 121-2 in turn. One ends of each of the secondary contact leads 121 are connected mechanically and electrically to the secondary printed circuit board 200 by soldering.

The secondary contact leads 121 are extended in straight from the secondary main surface of the secondary printed circuit board 200 in perpendicular to the main surface, respectively. The secondary contact leads 121 are supported by or embedded in the secondary insulator 122 approximately all over one to the other ends thereof.

When the secondary connector 12 is positioned so that the secondary contact leads 121 are directed in parallel to the second portions of the primary contact leads 111, the secondary contact leads 121 are connected to the second portion of the primary contact leads 111 as shown in FIG. 4. Herein, the second portions of the primary contact leads 111 and the secondary contact leads 121 are respectively connected to each other where each end of the second portions and each end of the secondary contact leads 121 are offset to one another in a depth direction of the connector unit extending in parallel to the first and the second primary main surfaces of the primary printed circuit board 100.

As is apparent from FIG. 4, a plurality of signal paths for transmitting signals are formed or established between the primary and the secondary printed circuit boards 100 and 200. The signal paths are substantially equal to one another in length because the secondary contact leads 121 have different lengths from one another so that respective sums of the primary and the secondary contact leads 111 and 121 are substantially equal to one another in length.

More specifically, a signal path established by the primary and the secondary contact leads 111-1 and 121-1, a signal path established by the primary and the secondary contact leads 111-2 and 121-2, a signal path established by the primary and the secondary contact leads 111-3 and 121-3 are approximately equal to one another. Therefore, signals transmitted through the signal paths are delayed by approximately equal delay times.

Furthermore, the connector unit can be reduced in height thereof even if the connector unit has many contact leads because the connector unit is mounted on the primary electric device so as to be located over both sides of the electric while not only one side of that. The reason is also why the primary and the secondary contact leads 111 and 121 are respectively connected to each other where each end of the second portions and each end of the secondary contact leads 121 are offset to one another in a depth direction of the connector unit extending in parallel to the first and the second primary main surfaces of the primary printed circuit board 100. In other words, the connector unit can be provided with a wide arrangement pitch of contact leads if the connector unit has the same number of the contact leads as the conventional unit. Thus, the connector unit has an advantage about the matter of the cross talk.

Second embodiment

A connector unit according to a second embodiment of the present invention has the secondary connector designated by the same reference numerals that are described in the first embodiment with illustrating by FIGS. 3 and 4. The secondary connector 12 is omitted in detailed description.

Figure 5:
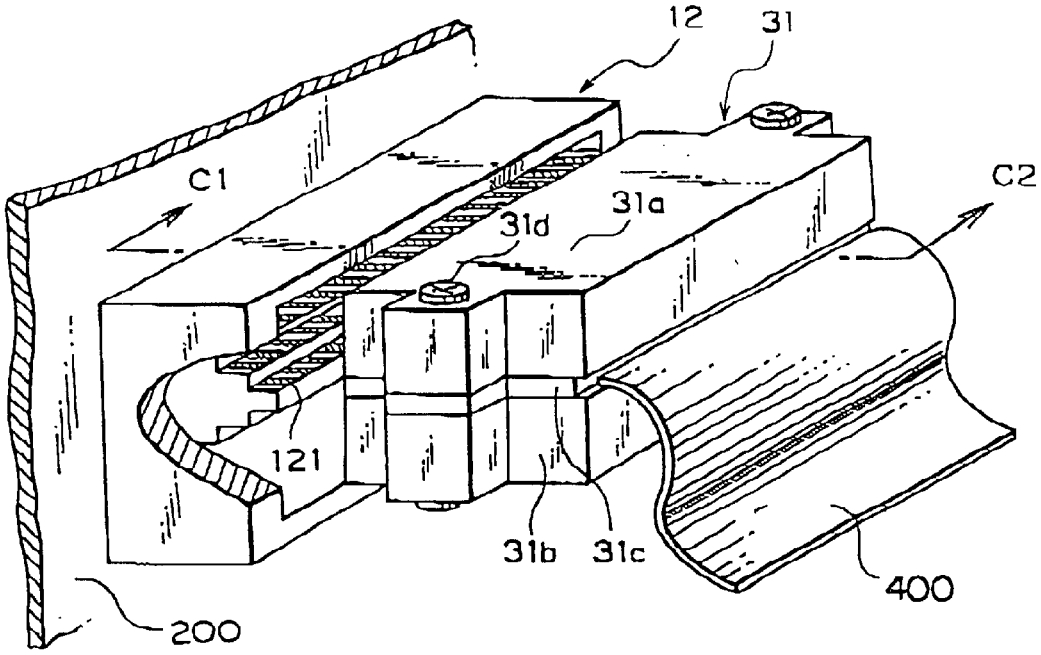
FIG. 5 is a perspective view showing a connector unit according to a second embodiment of the present invention.
Figure 6:
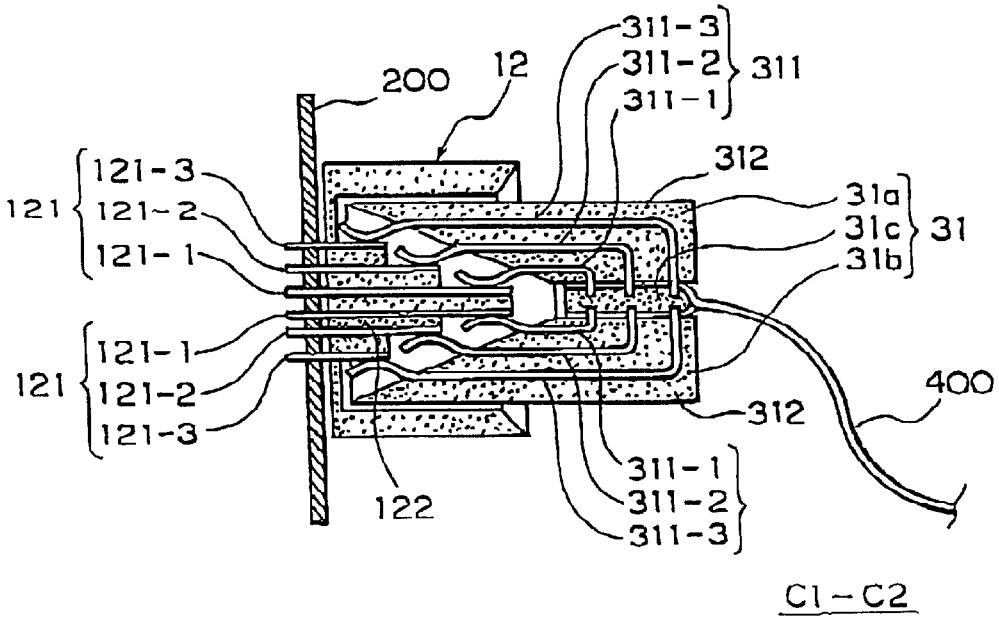
FIG. 6 is a cross sectional view of the connector unit with the two connectors thereof connected to each other shown in FIG. 5 along a line C1–C2 in FIG. 5.

Referring to FIGS. 5 and 6, the connector unit according to the second embodiment of the present invention is used for electrical and removable connection between a flat ribbon cable 400 as a primary electric device and the secondary printed circuit board 200 as a secondary electric device.

The flat ribbon cable 400 has a bifurcated or forked end which is divided into first and second end portions of the upper and the lower sides shown in FIG. 6. The first and the second end portions have printed wiring patterns (not shown) thereon, respectively.

The illustrated connector unit, it is to be noted that a primary connector 31 is different in structure from the primary connector 11 shown in FIG. 4 but the secondary connectors 1 2 are same as those of FIG. 4. The primary connector 31 is divided into first and second primary connectors 31*a* and 31*b* respectively connected to first and second end portions of the flat ribbon cable 400 and a spacer 31*c* held between the first and the second primary connectors 31*a* and 31*b* through the first and the second end portions of the flat ribbon cable 400.

The first and the second primary connectors 31*a* and 31*b* comprise a primary insulator 312 and a plurality of primary contact-sets, respectively. The primary contact-sets are provided with three primary contact leads (collectively shown by 311) and which are supported in the primary insulator 312, respectively. The primary contact-sets are arrayed horizontally in parallel with one another so that the primary contact leads 311 are superposed on one another with a space left in the primary insulator 312. The primary contact leads 311 are arranged in parallel to one another. The primary contact leads 311 have different lengths from one another like that of the first embodiment illustrated by FIGS. 3 and 4. More specifically, the primary contact lead 311 comprises primary contact leads 311-1, 311-2, and 311-3 as first through n-th primary contact leads. Herein, "n" is an integer not smaller than 2. The primary contact lead 311-2 is arranged over top of the primary contact lead 311-1 and the primary contact lead 311-3 is arranged over top of the primary contact lead 311-2 in turn. In other words, an n-th primary contact lead is arranged over top of an (n−1)-th primary contact lead in a height direction of the primary connector 31. Thus, the primary contact lead 311-2 is longer than the primary contact lead 311-1 and the primary contact lead 311-3 is longer than the primary contact lead 311-2 in turn.

The first and the second primary connectors 31*a* and 31*b* and the spacer 31*c* hold in cooperation with one another the first and the end portions of the flat ribbon cable 400 therebetween by using screws 31*d*. Thus, the primary contact leads 311 of the first and the second primary connectors 31*a* and 31*b* are press-fitted to the first and the second end portions of the flat ribbon cable 400, respectively. Namely, One ends of each of the primary contact leads 311 are capable of being connected mechanically and electrically to the flat ribbon cable 400 without soldering.

The primary contact leads 311 of the first and the second primary connectors 31*a* and 31*b* are provided with first portions which are extended from the flat ribbon cable 400 and second portions which are extended from the first portions in parallel to the flat ribbon cable 400, respectively. The primary contact leads 311 without one and the other ends thereof are supported by the primary insulator 312. One and the other ends of the primary contact leads 311 has elasticity, respectively.

When the secondary connector 12 is positioned so that the secondary contact leads 121 are directed in parallel to the second portions of the primary contact leads 311, the secondary contact leads 121 are connected to the primary contact leads 311 as shown in FIG. 6. Herein, the second portions of the primary contact leads 311 and the secondary contact leads 121 are respectively connected to each other where each end of the second portions and each end of the secondary contact leads 121 are offset to one another in a depth direction of the connector unit extending in parallel to the first and the second end portions of the flat ribbon cable 400.

As is apparent from FIG. 6, a plurality of signal paths for transmitting signals are formed or established between the flat ribbon cable 400 and the secondary printed circuit board 200. The signal paths are substantially equal to one another in length because the secondary contact leads 121 have different lengths from one another so that respective sums of the primary and the secondary contact leads 311 and 121 are substantially equal to one another in length.

More specifically, a signal path established by the primary and the secondary contact leads 311-1 and 121-1, a signal path established by the primary and the secondary contact leads 311-2 and 121-2, a signal path established by the primary and the secondary contact leads 311-3 and 121-3 are approximately equal to one another. Therefore, signals transmitted through the signal paths are also equal to one another in delay time.

Furthermore, the connector unit can be reduced in height thereof even if the connector unit has many contact leads because the connector unit is mounted on the flat ribbon cable 400 so as to be located on both sides of the flat ribbon cable 400 without being mounted on only one side of that. The reason is also why the primary and the secondary contact leads 311 and 121 are respectively connected to each other where each end of the second portions and each end of the secondary contact leads 121 are offset to one another in a depth direction of the connector unit extending in parallel to the first and the second end portions of the flat ribbon cable 400. In other words, the connector unit can be provided with a wide arrangement pitch of contact leads if the connector unit has contact leads equal number of the conventional unit. Thus, the connector unit has an advantage about the matter of the cross talk.

Third embodiment

A connector unit according to a second embodiment has the secondary connector designated by the same reference numerals that are described in the first and the second embodiments with illustrating by FIGS. 3 to 6, respectively. The secondary connector 12 is omitted in detailed description.

Figure 7:
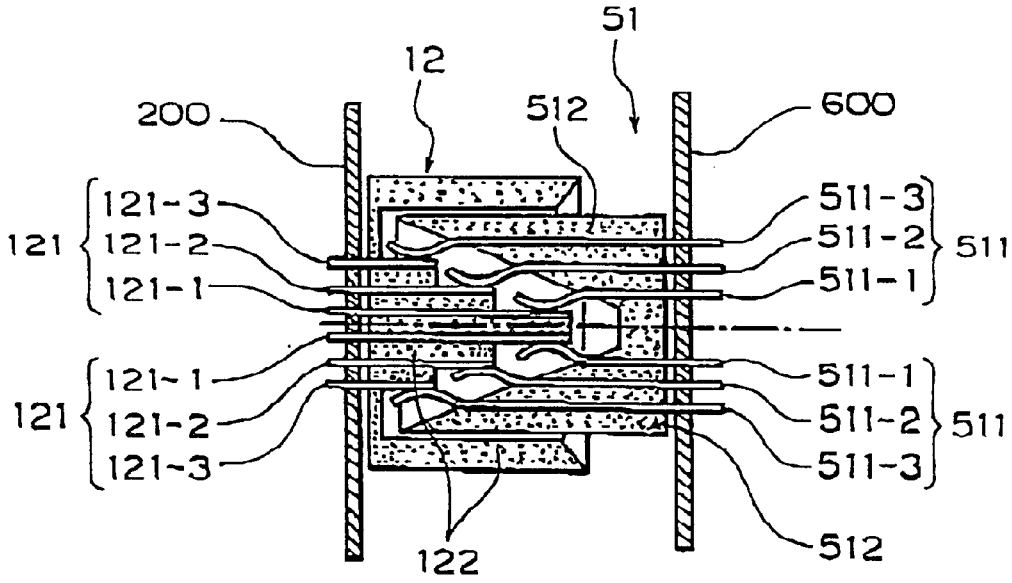
FIG. 7 is a cross sectional view showing a connector unit according to a third embodiment of the present invention.

Referring to FIG. 7, a connector unit according to a third embodiment of the present invention is used for electrical and removable connection between a primary printed circuit boards 600 as a primary electric device and the secondary printed circuit board 200 as the secondary electric device. The primary printed circuit board 600 is provided with a primary main surface.

The connector unit comprises a primary connector 51 and the secondary connector 12. The primary connector 51 comprises a primary insulator 512 and first and second contact lead-groups of primary contact leads. The first and the second contact lead-groups of the primary contact leads are provided with a plurality of primary contact-sets, respectively. The primary contact-sets are arrayed horizontally in parallel with one another so that the primary contact leads 511 are superposed on one another with a space left in the primary insulator 512. The primary contact-sets are provided with three primary contact leads (collectively shown by 511), respectively.

The primary contact leads 511 are arranged in parallel to one another. The primary contact leads 511 have different lengths from one another. More specifically, the primary contact lead 511 comprises primary contact leads 511-1, 511-2, and 511-3 as first through n-th primary contact leads. The primary contact lead 511-2 is arranged over top of the primary contact lead 511-1 and the primary contact lead 511-3 is arranged over top of the primary contact lead 511-2 in turn. In other words, an n-th primary contact lead is arranged over top of an (n−1)-th primary contact lead in a height direction of the primary connector 51. Thus, the primary contact lead 511-2 is longer than the primary contact lead 511-1 and the primary contact lead 511-3 is longer than the primary contact lead 511-2 in turn. One ends of each of the primary contact leads 511 are connected mechanically and electrically to the primary printed circuit board 600 by soldering.

The primary contact leads 511 are extended in straight from the primary main surface of the primary printed circuit board 600 in perpendicular to the main surface, respectively. The primary contact leads 511 are supported by the primary insulator 512 over one to the other ends thereof.

When the secondary connector 12 is positioned so that the secondary contact leads 121 are directed in parallel to the primary contact leads 511, the secondary contact leads 121 are connected to the primary contact leads 511 with the primary and the secondary printed circuit boards 600 and 200 parallel to each other. Herein, the primary contact leads 511 and the secondary contact leads 121 are respectively connected to each other where each end of the primary contact leads 511 and each end of the secondary contact leads 121 are offset to one another in a depth direction of the connector unit extending in parallel to the primary main surface of the primary printed circuit board 600.

As is apparent from FIG. 7, a plurality of signal paths for transmitting signals are formed or established between the primary and the secondary printed circuit boards 600 and 200. The signal paths are substantially equal to one another in length because the secondary contact leads 121 have different lengths from one another so that respective sums of the primary and the secondary contact leads 511 and 121 are substantially equal to one another in length.

More specifically, a signal path established by the primary and the secondary contact leads 511-1 and 121-1, a signal path established by the primary and the secondary contact leads 511-2 and 121-2, a signal path established by the primary and the secondary contact leads 511-3 and 121-3 are approximately equal to one another. Therefore, signals transmitted through the signal paths are also equal to one another in delay time.

Furthermore, the connector unit can be reduced in height thereof even if the connector unit has many contact leads because the primary and the secondary contact leads 511 and 121 are respectively connected to each other where each end of the primary contact leads 511 and each end of the secondary contact leads 121 are offset to one another in a depth direction of the connector unit extending in a direction remote from the primary main surface of the primary printed circuit board 600. In other words, the connector unit can be provided with a wide arrangement pitch of contact leads if the connector unit has contact leads equal number of the conventional unit. Thus, the connector unit has an advantage about the matter of the cross talk.

In the embodiments described above, one part connected to another part may be practically and concretely connected by the use of press-fitting or soldering. On the other hand, one part removably connected to another part may be practically and concretely connected by the use of press-fitting or the removable insertion of the ZIF—(Zero Insertion Force)— type known already.

While the present invention has thus far been described in conjunction with embodiments thereof, it will readily be possible for those skilled in the art to put the present invention into practice in various other manners.

What is claimed is:

1. A connector unit comprising a primary connector and a secondary connector, the primary connector comprising first and sections mounted to opposing surfaces of a plate-shaped electric device, each of the first and second sections comprising at least two parallel rows of contact leads, the contact leads of the rows extending beyond an edge of the electric device in a common direction, the respective rows of each section being arranged in a stacked fashion with respect to the electric device, and the ends of the contact leads of each respective row of each section being displaced with respect to ends of the contact leads of an adjacent row of the same section that is closer to the electric device in a direction that is outward from the edge electric device, the secondary connector comprising rows of contact leads complementary to the rows of contact leads of the first and second sections of the primary connector to provide simultaneous engagement between rows of contact leads of the primary connector and rows of contact leads of the secondary connector.

2. The connector unit claimed in claim 1, wherein the electric device is a printed circuit board having printed wiring patterns on said opposing surfaces.

3. The connector unit claimed in claim 1, wherein the electric device is a flat ribbon cable having printed wiring patterns on said opposing surfaces.

4. The connector unit claimed in claim 1, wherein the electric device is a forked ribbon cable and wherein a side of a first fork of the forked ribbon cable provides a first of said opposing surfaces a side of a second fork of the forked ribbon cable provides a second of said opposing surfaces.

* * * * *